US011649127B2

(12) United States Patent
Tsai

(10) Patent No.: US 11,649,127 B2
(45) Date of Patent: May 16, 2023

(54) APPARATUS FOR EXCHANGING PAPER ROLLS

(71) Applicant: CHAN LI MACHINERY CO., LTD., Taoyuan (TW)

(72) Inventor: Tung-I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 120 days.

(21) Appl. No.: 17/224,259

(22) Filed: Apr. 7, 2021

(65) Prior Publication Data

US 2022/0289508 A1 Sep. 15, 2022

(30) Foreign Application Priority Data

Mar. 11, 2021 (TW) ..... 110108610

(51) Int. Cl.
*B65H 19/12* (2006.01)
*B65H 16/02* (2006.01)

(52) U.S. Cl.
CPC ..... *B65H 19/126* (2013.01); *B65H 16/021* (2013.01)

(58) Field of Classification Search
None
See application file for complete search history.

(56) References Cited

U.S. PATENT DOCUMENTS 1,742,029 A * 12/1929 Priester ..... B65H 16/06 242/559.4
1,812,742 A * 6/1931 Priester ..... B65H 19/126 242/559.4
3,073,539 A * 1/1963 Brown ..... B65H 49/32 414/458
3,853,301 A * 12/1974 Kuconis ..... B66F 3/24 254/124

(Continued)

FOREIGN PATENT DOCUMENTS

CN 111056345 A 4/2020
JP 2793960 B2 9/1998

(Continued)

OTHER PUBLICATIONS

International Search Report Issued by Foreign Patent Office in Application No. 2021-074120.

*Primary Examiner* — William A. Rivera
(74) *Attorney, Agent, or Firm* — Rosenberg, Klein & Lee

(57) ABSTRACT

An apparatus for exchanging paper rolls includes a paper supply mechanism having an inclined arm and a clamp assembly for receiving and holding a first paper roll; a second-roll hanger assembly arranged above the paper supply mechanism for receiving and holding a second paper roll; a slide rail arranged between the paper supply mechanism and the second-roll hanger assembly; an elevating assembly movably mounted to the slide rail; and a driving assembly for driving the elevating assembly to move along the slide rail. The elevating assembly picks up the second (Continued)

paper roll from the second-roll hanger assembly. To exchange the first paper roll with the second paper roll, the clamp assembly pushes the first paper roll away from the paper supply mechanism, and the elevating assembly lowers down along the slide rail to place the second paper roll in the paper supply mechanism.

10 Claims, 15 Drawing Sheets

(56) References Cited

U.S. PATENT DOCUMENTS 3,963,187 A * 6/1976 Ohi ..... B65H 16/021 242/594.6
5,002,235 A * 3/1991 Greer ..... B65H 19/12 414/745.9
5,425,511 A * 6/1995 Pepe ..... B65H 54/54 242/596.7
5,542,623 A * 8/1996 Garand ..... B65H 19/126 242/559.4
5,607,120 A * 3/1997 Folsom ..... B65H 16/106 242/559.4
6,062,507 A * 5/2000 Summey, III ..... B65H 18/16 242/541.6
2002/0104917 A1* 8/2002 Mausser ..... B65H 18/26 242/541.7
2003/0089816 A1* 5/2003 Hanson ..... B65H 19/1889 242/559
2004/0118964 A1* 6/2004 Long ..... B65H 19/126 242/555.3

FOREIGN PATENT DOCUMENTS

JP 3086808 U 7/2002
JP 6219638 B2 10/2017

* cited by examiner

APPARATUS FOR EXCHANGING PAPER ROLLS

BACKGROUND OF THE INVENTION

1. Field of the Invention

The present invention relates to a paper roll supply mechanism, and particularly to a paper roll exchange mechanism for exchanging a working paper roll about to be used up with a fresh paper roll in the paper roll supply mechanism.

2. The Related Arts

In a rolled material supplying process, a rolled material in a cylindrical form, such as a paper roll, paper towel, and fabric roll, must be supplied in an unhindered manner to subsequent processing equipment. In the existing technology, a roll material supply mechanism is installed in front of the processing equipment to receive and carry the cylindrical material roll for feeding material from the cylindrical material roll.

A structure of the cylindrical paper roll is such that a thin piece of paper is wound, in a layer-by-layer manner, around a tube or core to form a cylindrical paper roll of a predetermined diameter. To feed the paper, the cylindrical paper roll is caused to rotate with the tube as a rotating center, and an end of the paper is guided to the subsequent processing equipment.

In the existing technology, once a paper roll is used up, human intervention is required for exchange with a fresh paper roll in order to continue the feeding of material. To ensure non-interrupted feeding of material from the cylindrical paper roll or to shorten the time for roll exchange, a roll exchange apparatus is adopted. In an existing roll exchange mechanism, a swing arm structure or a pneumatic cylinder driven roll switching mechanism is used.

For example, Chinese Patent No. CN111056345 proposes a roll exchange process that involves two conveyors, respectively set up at a left side and a right side, to operate in collaboration with a swing arm structure. Due to the swing arm arrangement, a conveyance path of paper rolls is generally of an arc form, such that it might be difficult to ensure stability of the paper rolls.

Further, the known swing arm structure and the pneumatic cylinder driving paper roll structure suffer drawbacks of mechanism being complicated and the swing arm requiring a large space for swinging. When the diameter of the paper roll is large, the swing arm has to be lengthened, and under such a condition, the height and the length have to be both enlarged. Since a space is requiring for the swing arm to swing, there is waste of space, and further, the swing arm suffers reduced rigidity if the length is increased, and further, the output power of the hydraulic cylinder or pneumatic cylinder has to be increased.

SUMMARY OF THE INVENTION

In view of the above, the primary objective of the present invention is to provide a paper roll exchange apparatus that adopts a simplified mechanism arrangement and an easy operation to exchange paper rolls.

The technical solution adopted by the present invention to achieve the above objective a paper supply mechanism including an inclined arm and a clamp assembly, the inclined arm having a free end and a positioning end fixed to a machine frame, a recess being formed on the positioning end to receive and support a first paper roll therein; a second-roll hanger assembly arranged at a position above the paper supply mechanism and spaced from the paper supply mechanism in a vertical direction, including a second paper roll hanger to receive and support a second paper roll thereon; a slide rail arranged between the paper supply mechanism and the second-roll hanger assembly in the vertical direction, a feeding position being defined at a bottom end of the slide rail adjacent to the paper supply mechanism, a pick-up position being defined at a top end of the slide rail adjacent to the second-roll hanger assembly, and a standby position being defined between the feeding position and the pick-up position; an elevating assembly movably mounted to the slide rail and including an elevating hanger; and a driving assembly coupled to the elevating assembly and operable to drive the elevating assembly to move upward or downward along the slide rail in the vertical direction to one of the feeding position, the pick-up position and the standby position.

Preferably, the free end of the inclined arm defines a collecting position to receive and hold the first paper roll ejected and pushed out of the recess of the inclined arm by the clamp assembly.

Preferably, the clamp assembly is coupled by a clamp axle to the inclined arm at a location beside the recess, and the clamp assembly is drivable by a clamp driver to rotate about a rotation center defined by the clamp axle.

Preferably, the second paper roll hanger is coupled by a second paper roll hanger axle to the machine frame, and the second paper roll hanger is drivable by a second paper roll hanger driver to rotate about a rotation center defined by the second paper roll hanger axle.

Preferably, the elevating assembly comprises a slide block, the elevating hanger being coupled by an elevating hanger axle to the slide block, the slide block being drivable by the driving assembly to move in the vertical direction along the slide rail to one of the pick-up position, the standby position, and the feeding position.

Preferably, the elevating assembly comprises an elevating hanger driver coupled to the elevating hanger, and the elevating hanger is drivable by the elevating hanger driver to cause the elevating hanger to rotate by an angle about a rotation center defined by the elevating hanger axle.

Preferably, the driving assembly comprises a screw rod which is in screwing engagement with a screw guide hole formed in the slide block; and a screw rod driving unit coupled to the screw rod to drive the screw rod to rotate in order to cause the slide block to move along the slide rail in the vertical direction.

Preferably, a paper roll rotating mechanism is operable to drive the first paper roll to rotate about a rotation center defined by the recess.

Preferably, the paper roll rotating mechanism comprises a lifting rack including an axle and a lifting end; a belt motor coupled to the axle of the lifting frame; a guide roller coupled to the lifting end of the lifting frame; and a belt arranged between the guide roller and the belt motor, the belt being set in contact engagement with a paper roll surface of the first paper roll; wherein the belt is drivable by the belt motor to rotate so as to drive the first paper roll to rotate.

Preferably, the paper roll rotating mechanism further comprises a lifting driver coupled to the lifting rack to drive the lifting rack to rotate about a rotation center defined by the axle, so as to cause the lifting end of the lifting rack to lift upward to set the belt in contact engagement with the paper roll surface of the first paper roll.

In respect of efficacy, the present invention realizes a function of paper roll exchange by adopting a simple exchange mechanism and achieves the following advantages:

(1) The drawbacks of the prior art based on swing arm and pneumatic cylinder driving that involves a complicated structure, and requires a large space for swinging of the swing arm, leading to a waste of space, and the rigidity of the swing arm is lowered once the length of the swing arm is increased, and the output power of the pneumatic cylinder needs to increase, can be effectively alleviated.

(2) The prior art swing arm based device involves a swing arm that require a circular arc paper roll moving path and it is hard to ensure stability during the process of movement. The present invention adopts vertical movement arrangement, which prevents the paper roll from oscillate or swing frontward and rearward so that the mechanism is kept in a more stable condition.

(3) The present invention is implemented with screw rod based transmission, which does not need extra floor area and space and requires only a sufficient vertical height.

(4) The present invention provides an arrangement that provides a space for temporarily holding a paper roll, so that an old paper roll (that is being in use) and a new paper roll (that is put in stand-by) are allowed to simultaneously deposited on the machine as being arranged in a vertical direction, so that storage space on the floor can be reduced.

(5) The present invention includes an elevating assembly having a hanger that is positioned by an axle and is drivable by a driver to have the hanger reaching out and retracting back, and such a mechanism is simple and stable.

(6) The prior art is operated to move the paper roll with a horizontal movement, which is carried out with a slide rail based mechanism. However, the paper roll has a substantial gravity that acts as a sideway force to the horizontal slide rail, so that the slide rail, as well as the slide block, may be damaged easily. The present invention adopts an elevating hanger movement arrangement to replace the known horizontal movement arrangement and the gravity of the paper roll is supported by the hanger, and the torque generated by the gravity is supported by a power cylinder, so that the structure is made stable.

(7) The present invention involves an arrangement of a fixed hanger that provides temporary storage for a fresh paper roll, so as to help shorten the operator standby time.

(8) The present invention includes an axle clamp provided in the paper supply mechanism. Such an axle clamp is combined with a driver to provide a simplified mechanism that is sufficiently operable to carry out operations of holding the axle of a paper roll in position and selectively ejecting and pushing the axle of the paper roll out of the recess of the paper supply mechanism.

(9) The present invention provides an arrangement that, in collaboration with a simple control device, enables automatic exchange operation to be executed once the paper roll is used up, and the operator just needs to place a fresh paper roll on the fixed hanger before the old paper roll has been used up. Since the fresh paper roll has already been put in standby on the elevating hanger, so that when the old paper roll is used up and removed out, the fresh paper roll can immediately lower down into the paper supply mechanism to continue with the old paper roll, thereby greatly reducing the time required for hanging the paper roll during paper roll exchange and the operation performance is greatly enhanced.

The present invention is applicable to cylindrical roll product, such as toilet tissue rolls, paper towels, and fabric rolls, and allows material feeding to reach the best performance.

A specific technical solution adopted in the present invention will be described in more details in respect of the following embodiments and the attached drawings.

DETAILED DESCRIPTION OF THE PREFERRED EMBODIMENTS

Figure 1:
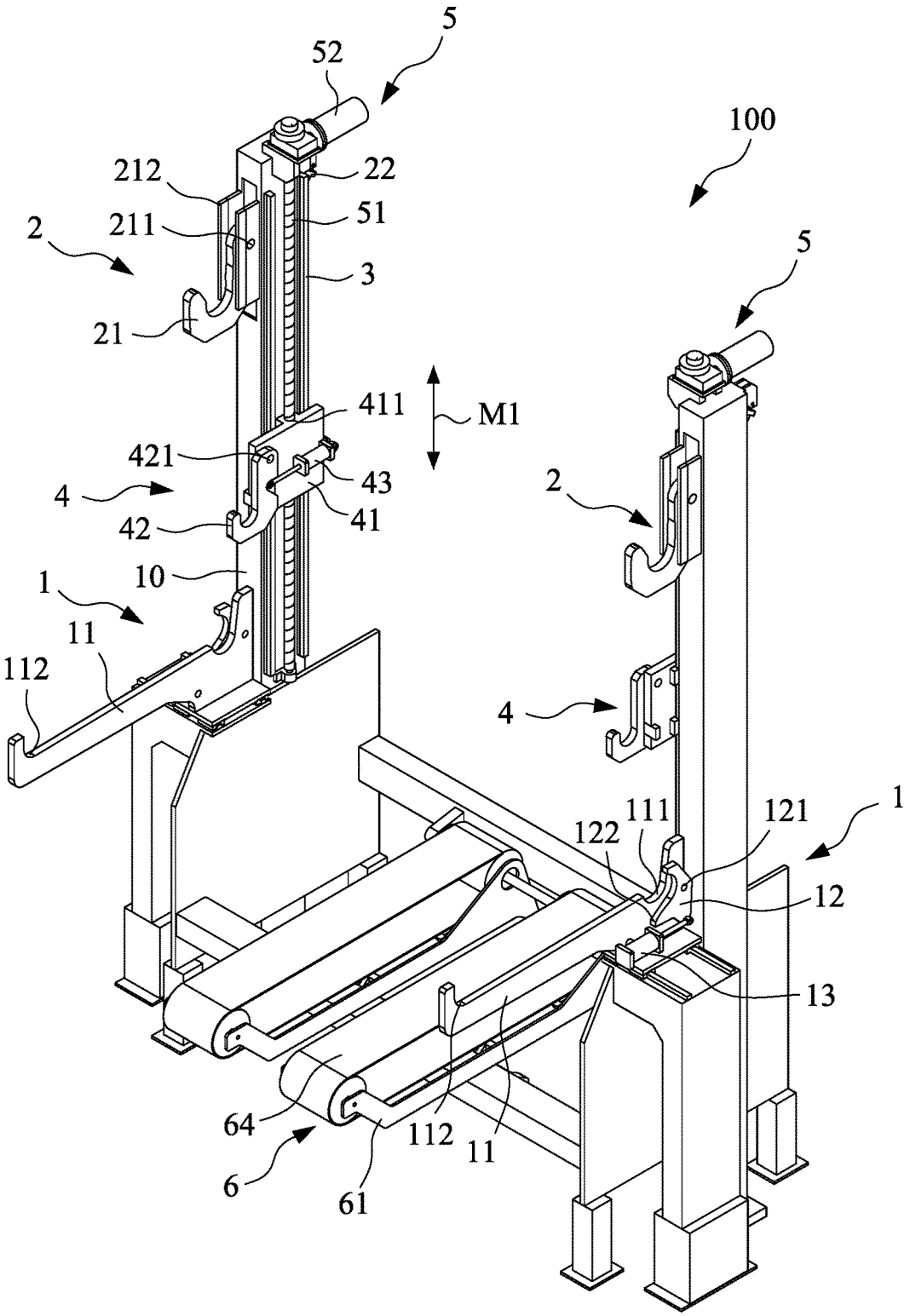
FIG. 1 is a perspective view showing a paper roll exchange apparatus according to the present invention.
Figure 2:
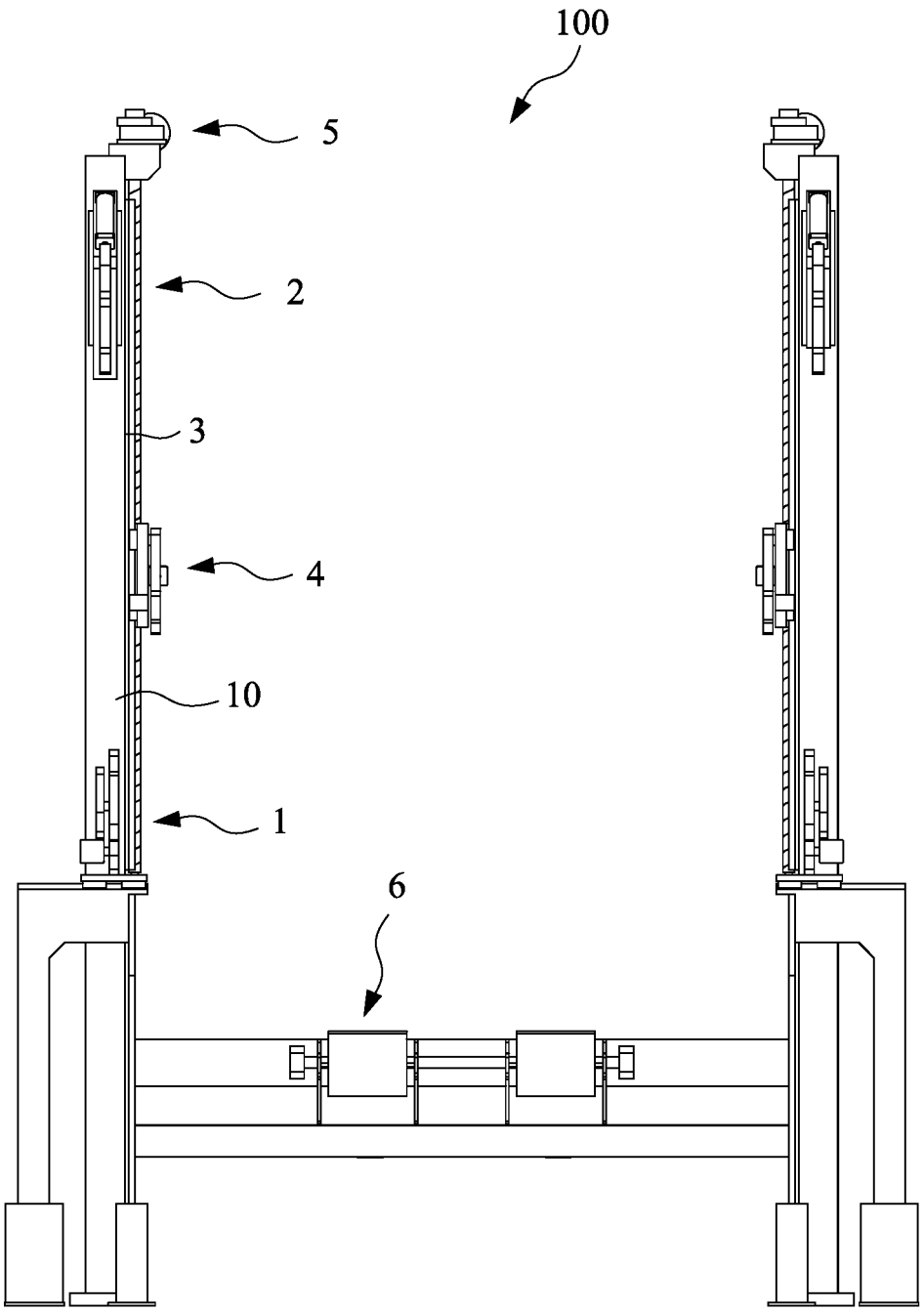
FIG. 2 is a front view showing the paper roll exchange apparatus according to the present invention.
Figure 3:
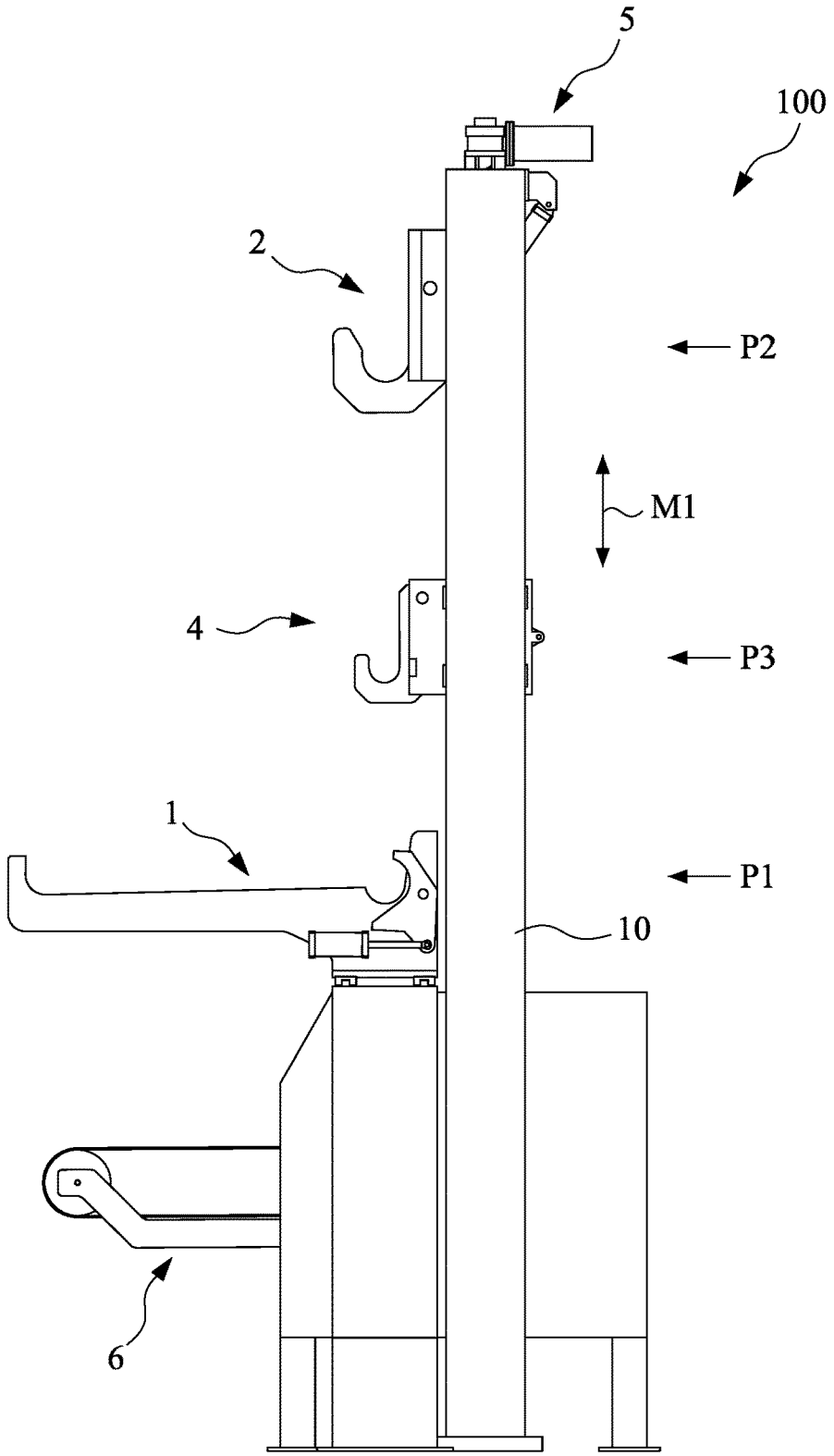
FIG. 3 is a side elevational view showing the paper roll exchange apparatus according to the present invention.

Referring to FIGS. 1-3, a paper roll exchange apparatus 100 according to the present invention generally comprises a paper supply mechanism 1, a second-roll hanger assembly 2, a slide rail 3, an elevating assembly 4, a driving assembly 5 and a paper roll rotating mechanism 6. The paper supply mechanism 1 carries and supports a first paper roll A1, and the second-roll hanger assembly 2 carries and support a second paper roll A2.

The paper supply mechanism 1 comprises a machine frame 10 that is arranged in a left-right corresponding form and a pair of inclined arms 11 coupled to the machine frame 10. Each of the inclined arms 11 has a positioning end at a right side thereof and fixed to the machine frame 10, and is formed with a recess 111 to receive, hold, and support a first reeling core A11 of the first paper roll A1. The inclined arm 11 has a free end at a left side thereof and extending for a length to define a collecting position 112.

A clamp assembly 12 comprises a clamp axle 121 coupled to the inclined arms 11 at a location beside the recess 111. The clamp assembly 12 is provided with an ejecting part 122 projecting therefrom and is coupled to a clamp driver 13. The clamp driver 13 can be for example a hydraulic cylinder, a pneumatic cylinder, or any other equivalent driving device.

Figure 4:
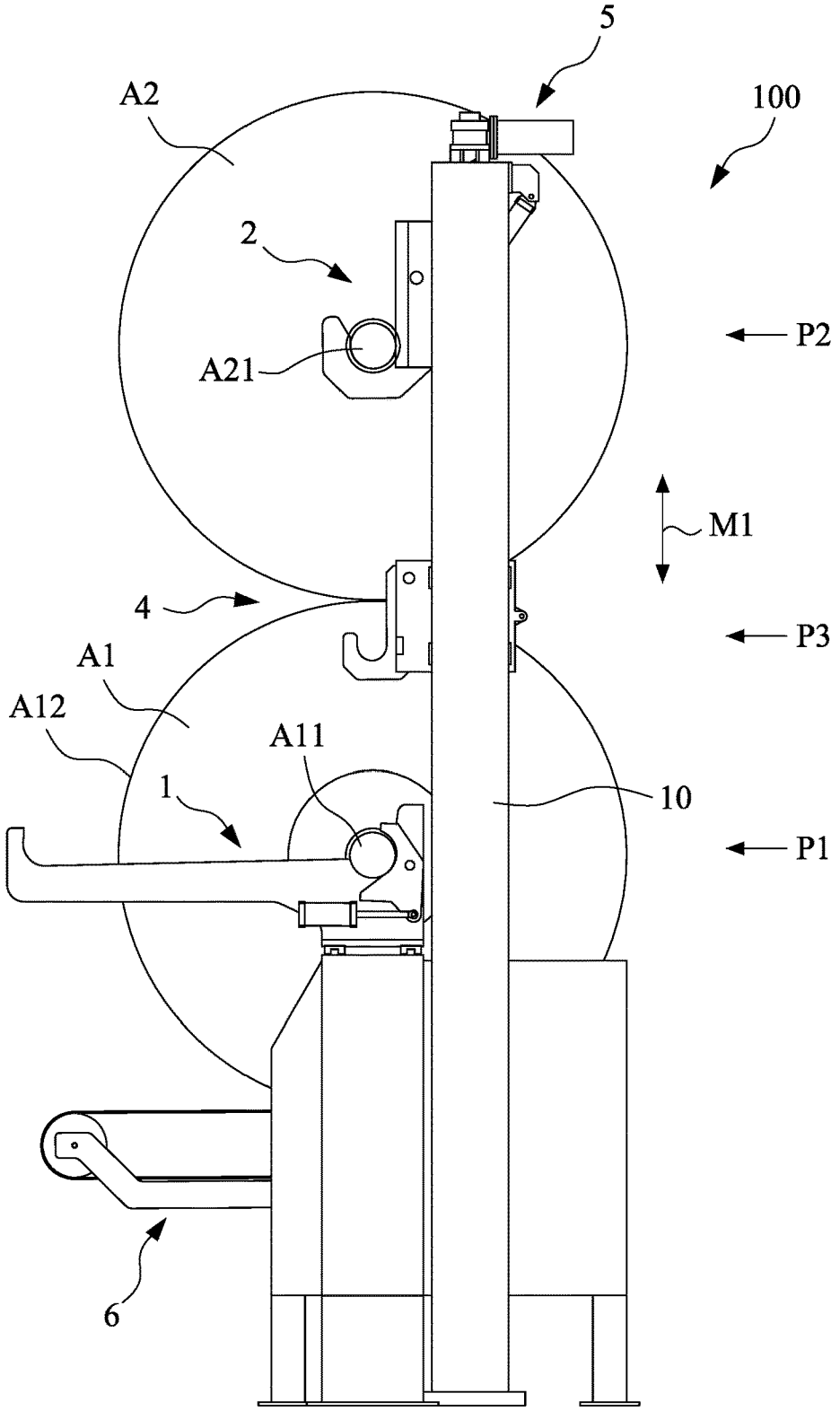
FIG. 4 is a side elevational view illustrating the paper roll exchange apparatus according to the present invention carrying and supporting a first paper roll and a second paper roll.

Also referring to FIG. 4, the second-roll hanger assembly 2 is arranged above disposed the paper supply mechanism 1 at a location corresponding thereto, such that the two are spaced from each other by a height-wise in a vertical direction. The second-roll hanger assembly 2 comprises a second paper roll hanger 21 and a second paper roll hanger driver 22. The second paper roll hanger 21 is coupled by a second paper roll hanger axle 211 to the machine frame 10. The second paper roll hanger driver 22 can be for example a hydraulic cylinder, a pneumatic cylinder, or any other equivalent driving device. A rubber pad 212 is provided at the site where the second paper roll hanger 21 is mounted, in order to reduce potential risk of structure damage caused by undesired collision occurring during hanging and depositing paper rolls.

Figure 5:
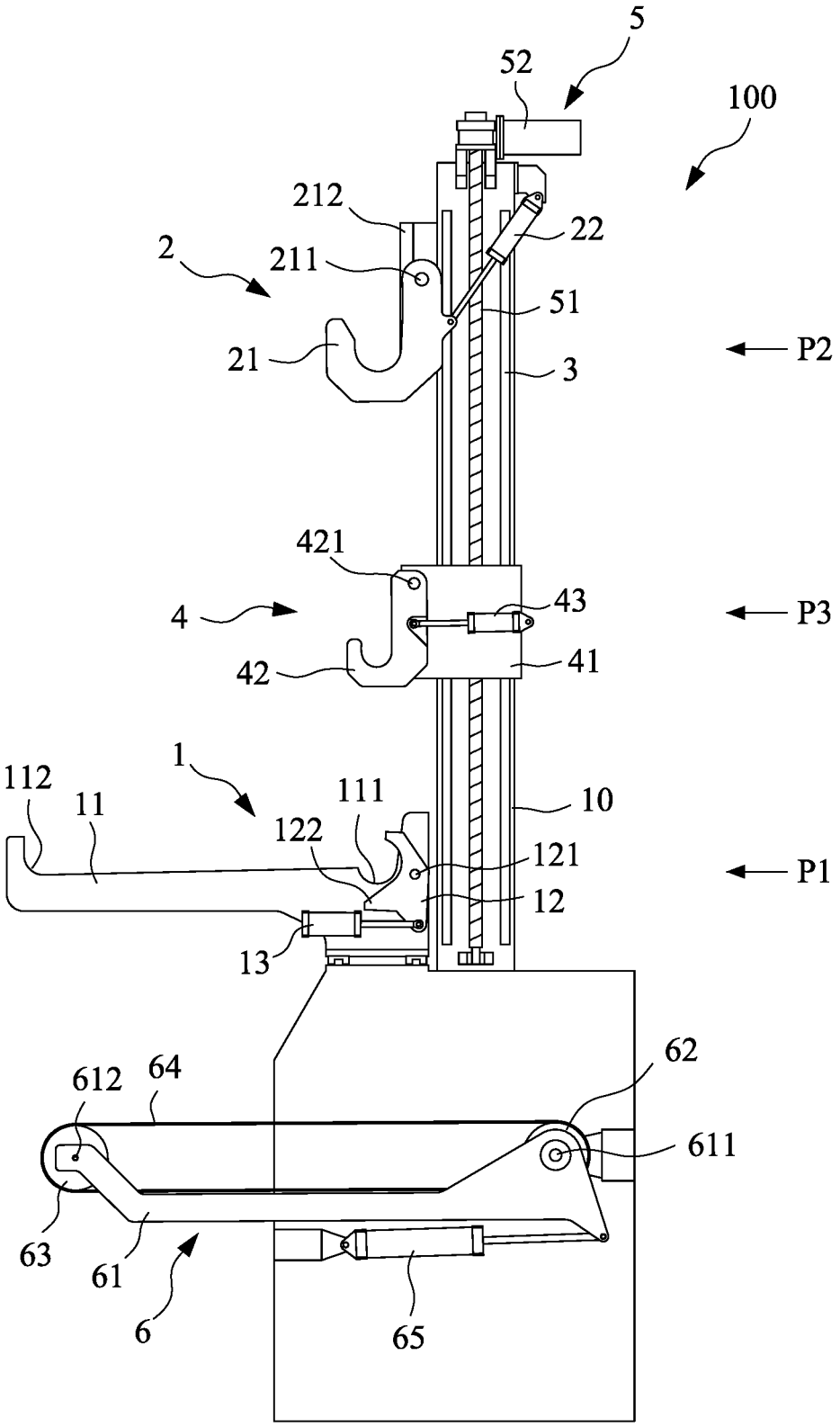
FIG. 5 is a cross-sectional view showing, partly, a combination relationship of related components of the paper roll exchange apparatus according to the present invention.

Also referring to FIG. 5, it is a cross-sectional view showing, partly, a combination relationship of related components of the paper roll exchange apparatus according to the present invention. A slide rail 3 is arranged between the paper supply mechanism 1 and the second-roll hanger assembly 2. A feeding position P1 is defined at a bottom end of the slide rail 3 adjacent to the paper supply mechanism 1, a pick-up position P2 is defined at a top end of the slide rail 3 adjacent to the second-roll hanger assembly 2, and a standby position P3 is defined between the feeding position P1 and the pick-up position P2.

The elevating assembly 4 is movably coupled to the slide rail 3. The elevating assembly 4 comprises a slide block 41, an elevating hanger 42, and an elevating hanger driver 43. The elevating hanger 42 is coupled by an elevating hanger axle 421 to the slide block 41. The elevating hanger driver 43 can be for example a hydraulic cylinder, a pneumatic cylinder, or any other equivalent driving device.

The driving assembly 5 is coupled to the elevating assembly 4 to drive the elevating assembly 4 to move, in a vertical direction M1 along the slide rail 3, to one of the pick-up position P2, the standby position P3, and the feeding position P1.

The driving assembly 5 comprises a screw rod 51 and a screw rod driving unit 52. The screw rod 51 is set in screwing engagement with a screw guide hole 411 formed in the slide block 41 (as shown in FIG. 1). When the screw rod 51 is rotating as being driven by the screw rod driving unit 52, the slide block 41 is caused to elevate or lower down along the slide rail 3 in the vertical direction M1.

The paper roll rotating mechanism 6 is arranged at a location below the paper supply mechanism 1 to drive the first paper roll A1 to rotate about a rotation center defined by the recess 111, or an axle thereof is rotating within the recess. The paper roll rotating mechanism 6 comprises a lifting rack 61, which has an axle 611 and a lifting end 612. A belt motor 62 is coupled to the axle 611. A guide roller 63 is coupled to the lifting end 612. A belt 64 is arranged between the belt motor 62 and the guide roller 63. The belt 64 is driven by the belt motor 62 to rotate.

The lifting rack 61 is coupled to a lifting driver 65, and is driven by the lifting driver 65 to rotate about a rotation center defined by the axle 611 for a lifting angle about, in order to keep the belt 64 in contact with a paper roll surface A12 of the first paper roll A1 to thereby drive the first paper roll A1 to rotate clockwise.

Figure 6A:
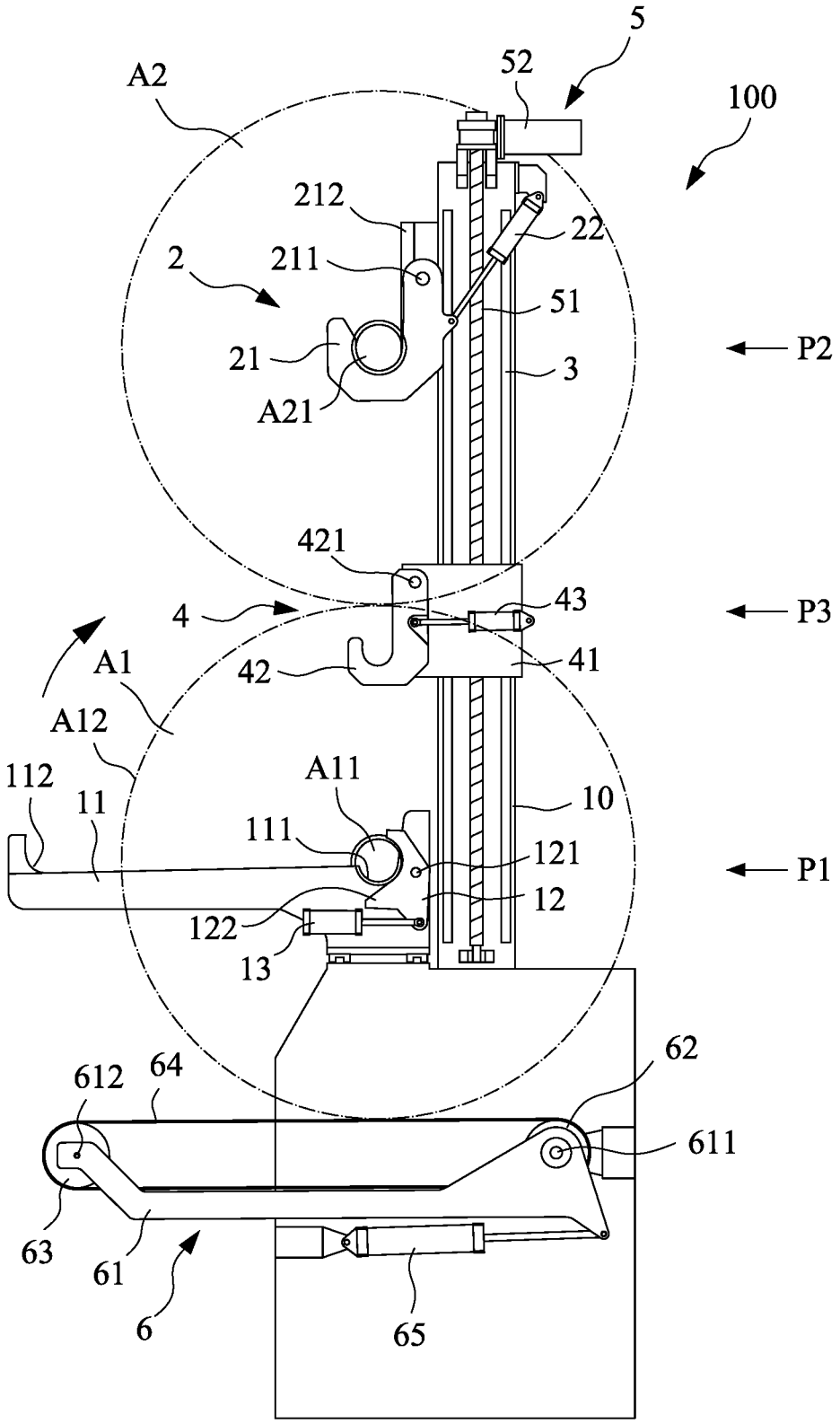
FIGS. 6A-6J are schematic views illustrating processes of paper roll exchange according to the present invention.

FIGS. 6A-6J are schematic views illustrating processes of roll exchange according to the present invention. For clearly illustrating the structures of the components and a relationship among such components, the first paper roll A1 and the second paper roll A2 are outlined with phantom lines in each of these drawings. As shown in FIG. 6A, the height-wise distance between the paper supply mechanism 1 and the second-roll hanger assembly 2 is sufficient to accommodate two paper rolls of identical diameters, namely the first paper roll A1 and the second paper roll A2. The first paper roll A1 is driven by the paper roll rotating mechanism 6 to rotate for feeding toward subsequent processing equipment (not shown). During the process of feeding paper from the first paper roll A1, an operator may hang and deposit, in a manner of manual operation or automatic operation, the second paper roll A2 on the second paper roll hanger 21 of the second-roll hanger assembly 2.

Figure 6B:
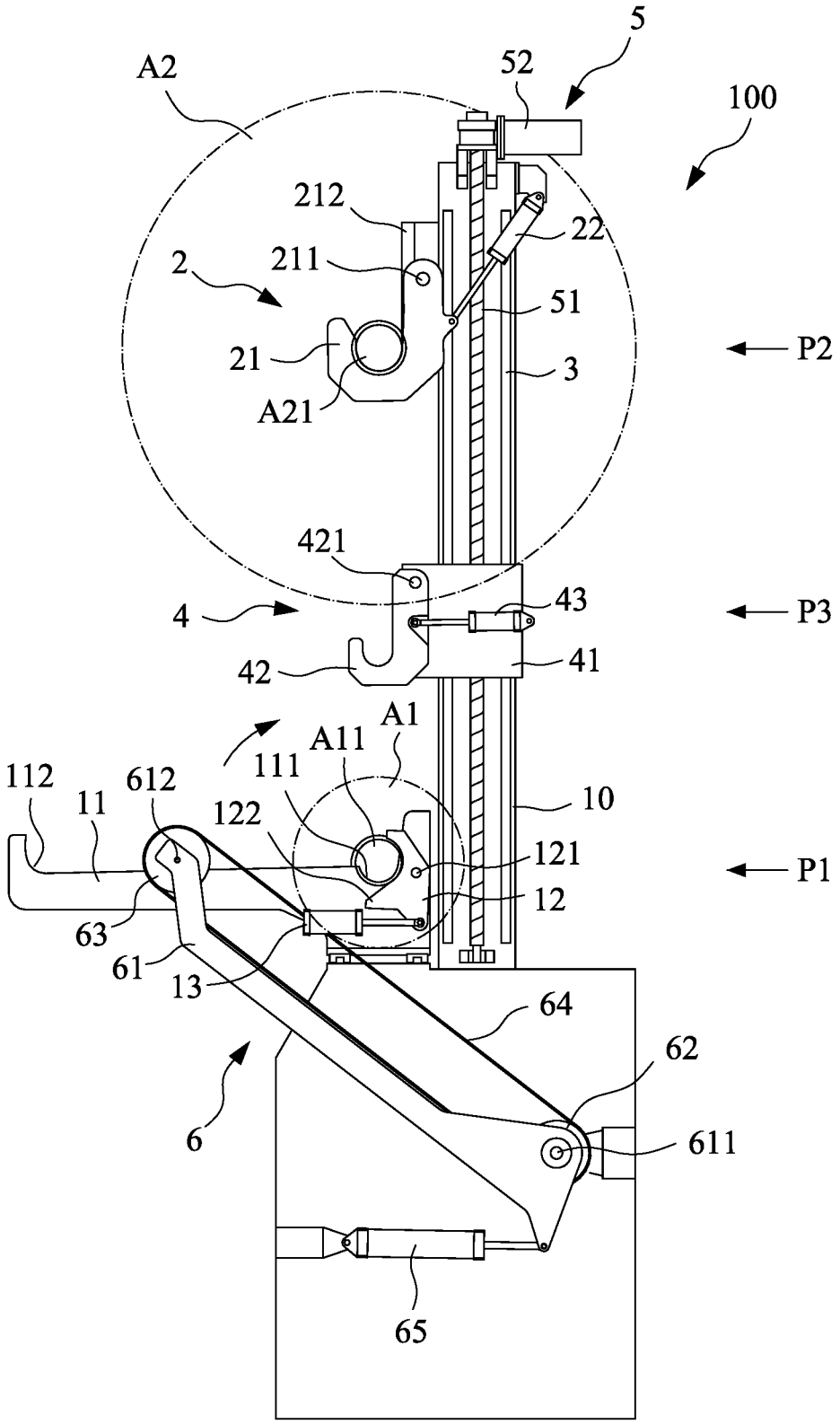
Figure 6C:
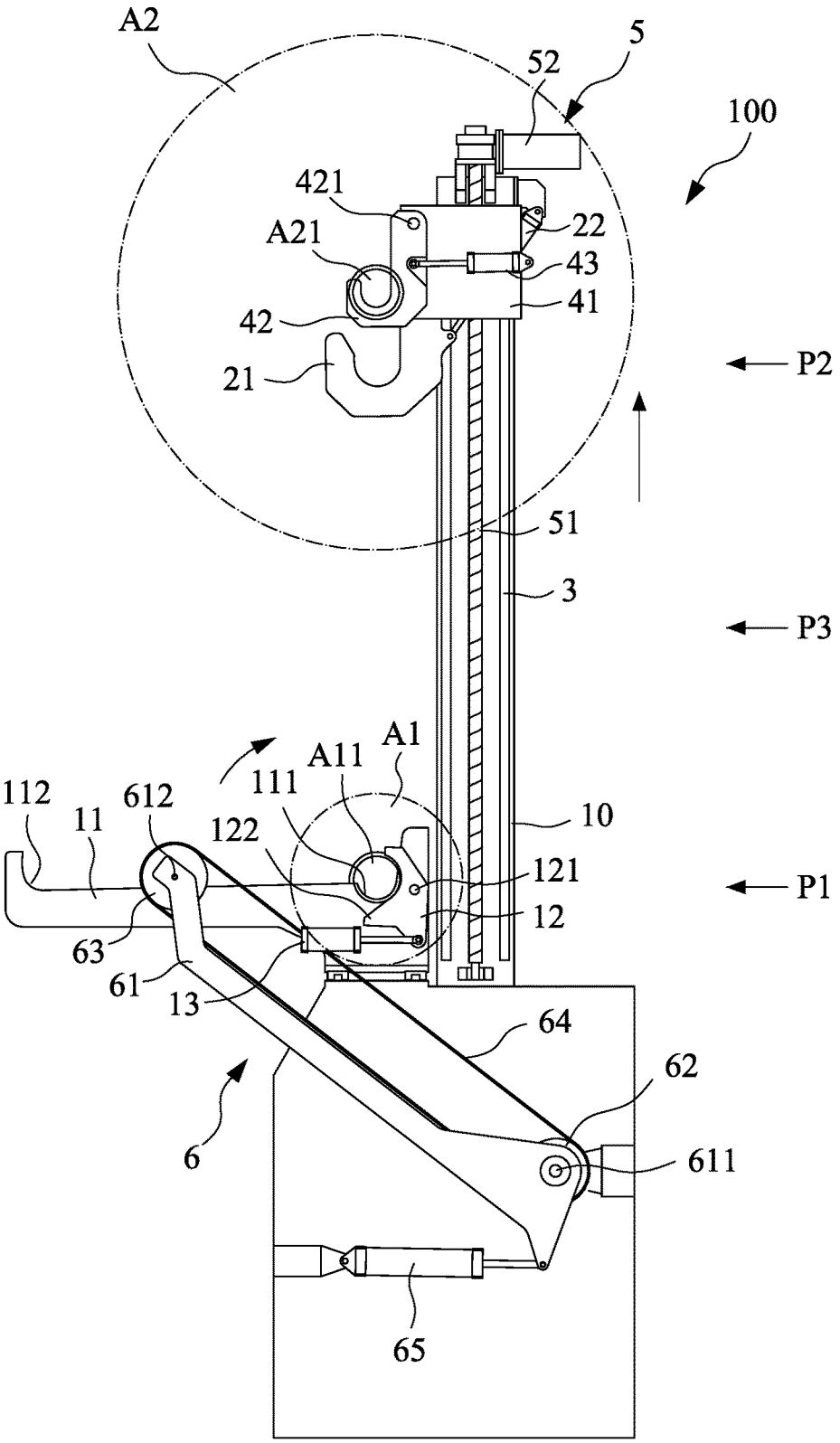
Figure 6D:
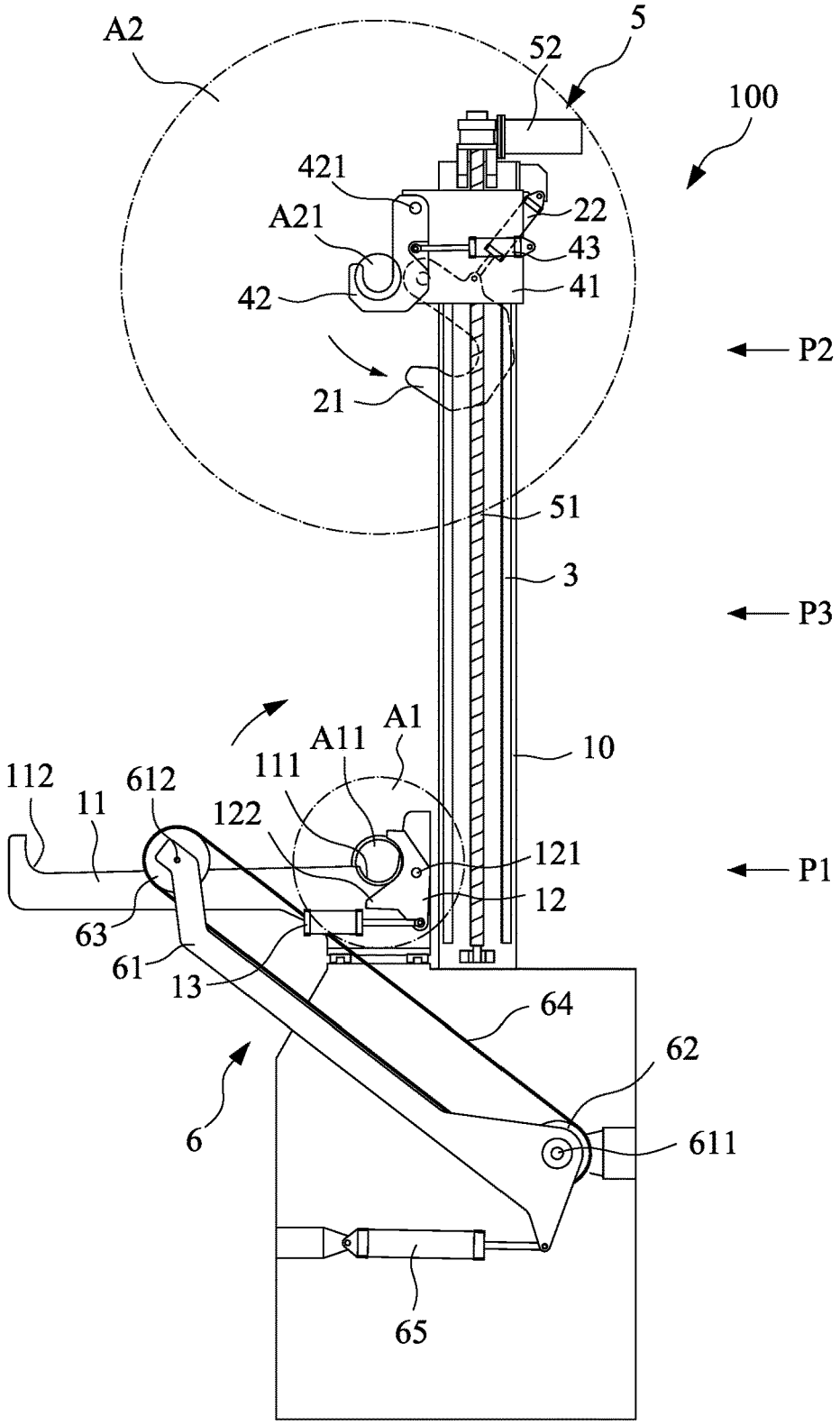
Figure 6E:
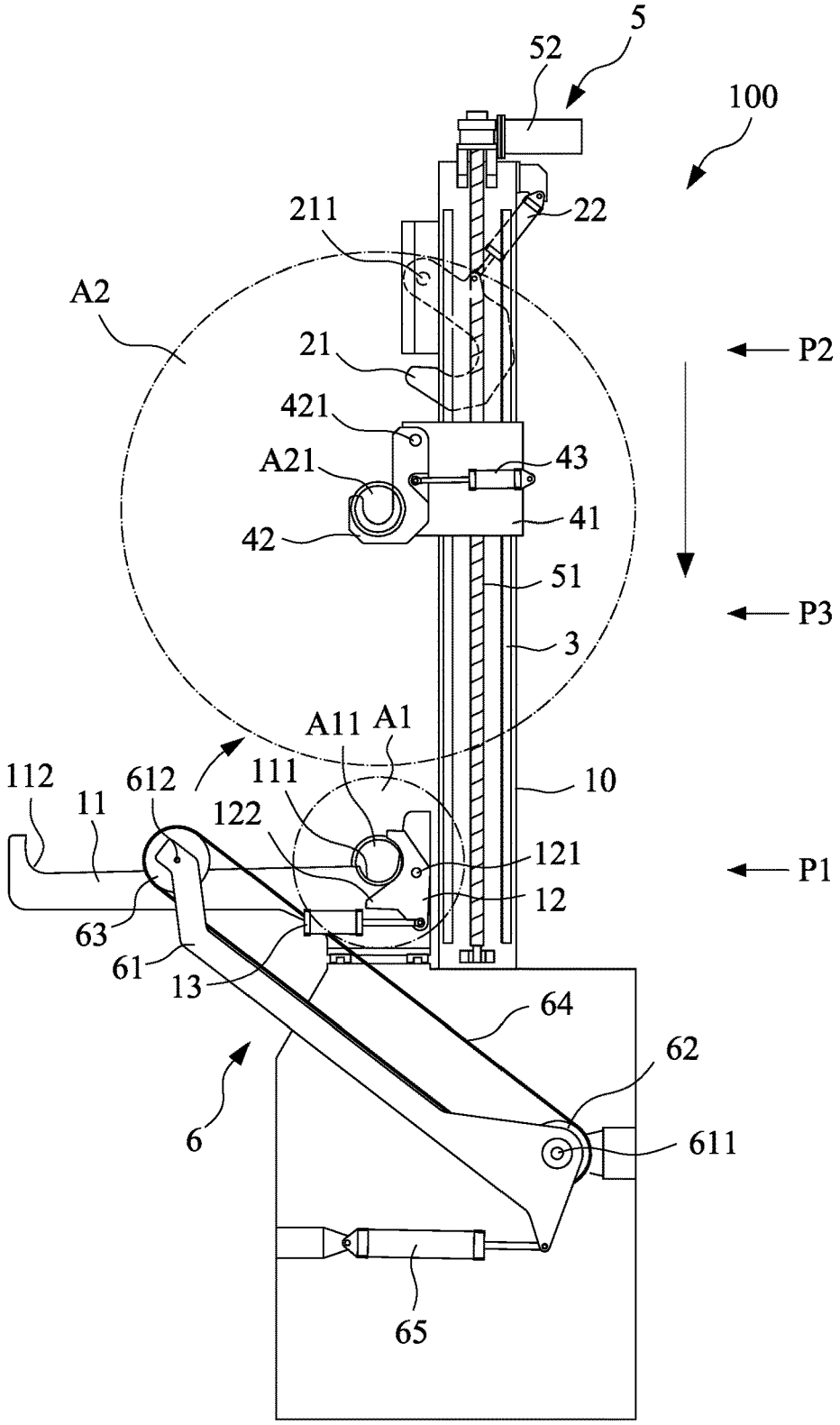

When the first paper roll A1 of which paper has been fed out reaches a predetermined diameter (as shown in FIG. 6B), through detection and control by a controlling device (not shown), the driving assembly 5 drives the elevating assembly 4 to move upward along the slide rail 3 to the pick-up position P2 (as shown in FIG. 6C) to lift the second paper roll A2 that is hung on the second-roll hanger assembly 2 for a height. Then, the second paper roll hanger 21 is driven by the second paper roll hanger driver 22 to retract backward in a counterclockwise direction (also see FIG. 6D) to deliver and transfer the second paper roll A2 to the elevating hanger 42, such that the elevating assembly 4 may lower the second paper roll A2 along the slide rail 3 to the standby position P3 (as shown in FIG. 6E).

Figure 6F:
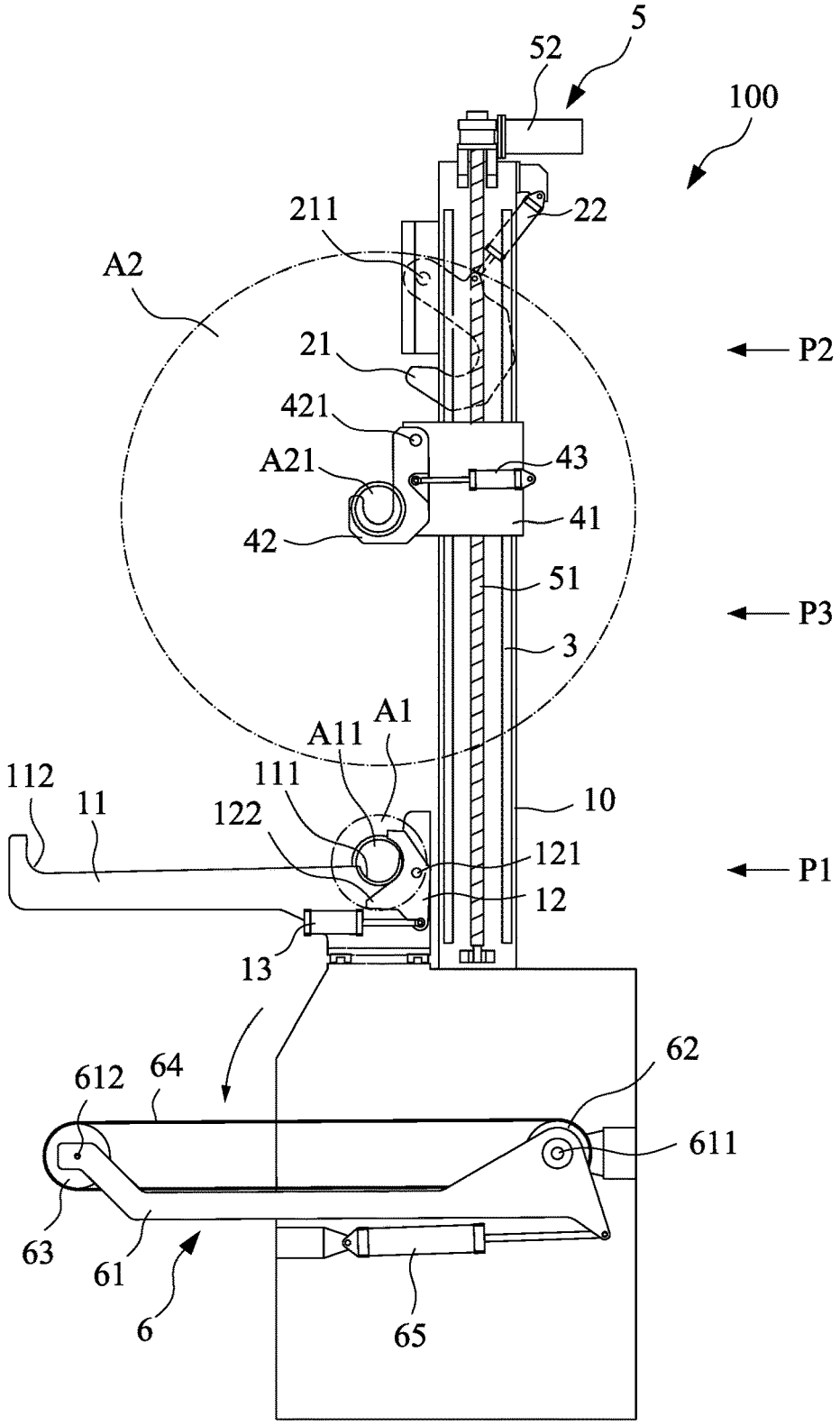

When the first paper roll A1 is completely used up, the belt 64 of the paper roll rotating mechanism 6 is caused to slow down and the lifting rack 61 is driven by the lifting driver 65 to move in a counterclockwise direction back to a horizontal position (as shown in FIG. 6F).

Figure 6G:
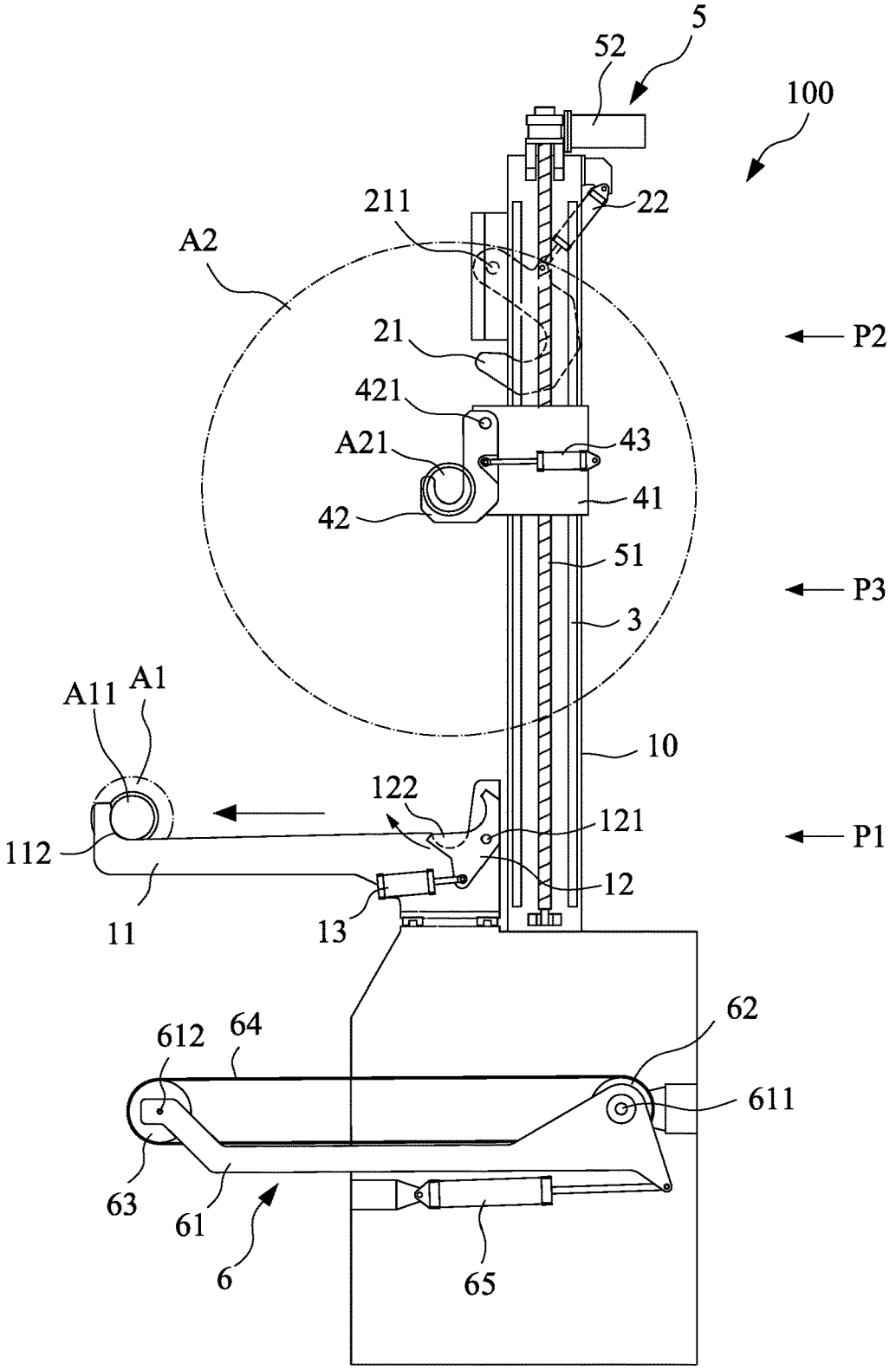

Afterwards, the clamp driver 13 drives the clamp assembly 12 to rotate, about a rotation center defined by the clamp axle 121, in a clockwise direction by an angle (as shown in FIG. 6G), such that the ejecting part 122 of the clamp assembly 12 pushes and ejects the first reeling core A11 of the first paper roll A1 in an upward inclining direction. As such, the first reeling core A11 is caused to move out of the recess 111 of the inclined arms 11 and roll along the inclined arms 11 to reach the collecting position 112 to be temporarily kept there for subsequent collection.

Figure 6H:
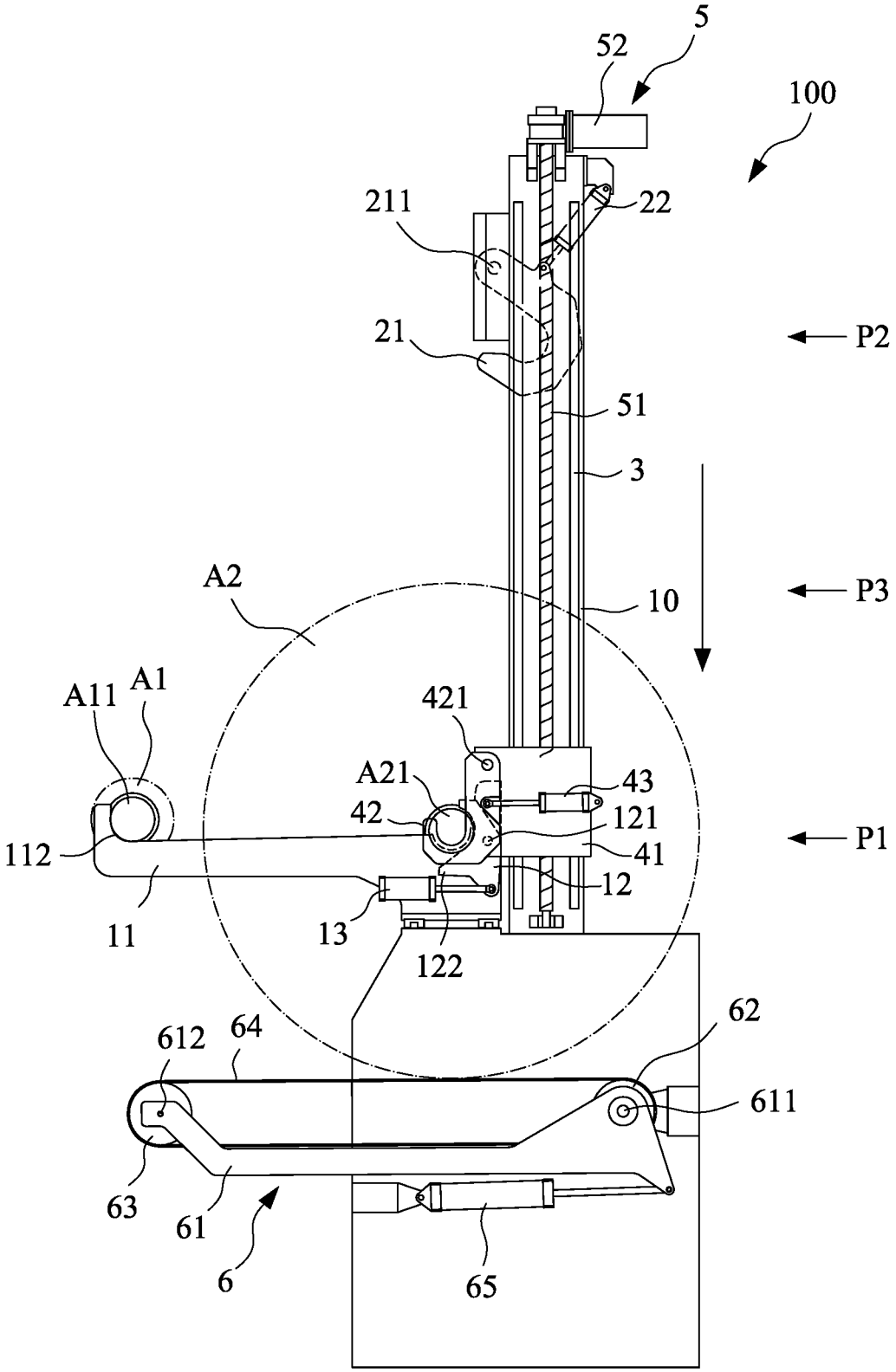

When the first paper roll A1 retracts and moves out, the elevating assembly 4 is lowered down to the feeding position P1 (as shown in FIG. 6H), such that the second reeling core A21 of the second paper roll A2 is moved into and deposited in the recess 111 of the inclined arms 11 to be supported therein, and then, the clamp driver 13 drives the clamp assembly 12 to press down and hold the second reeling core A21 of the second paper roll A2 to keep the second paper roll A2 is position and not separating therefrom.

Figure 6I:
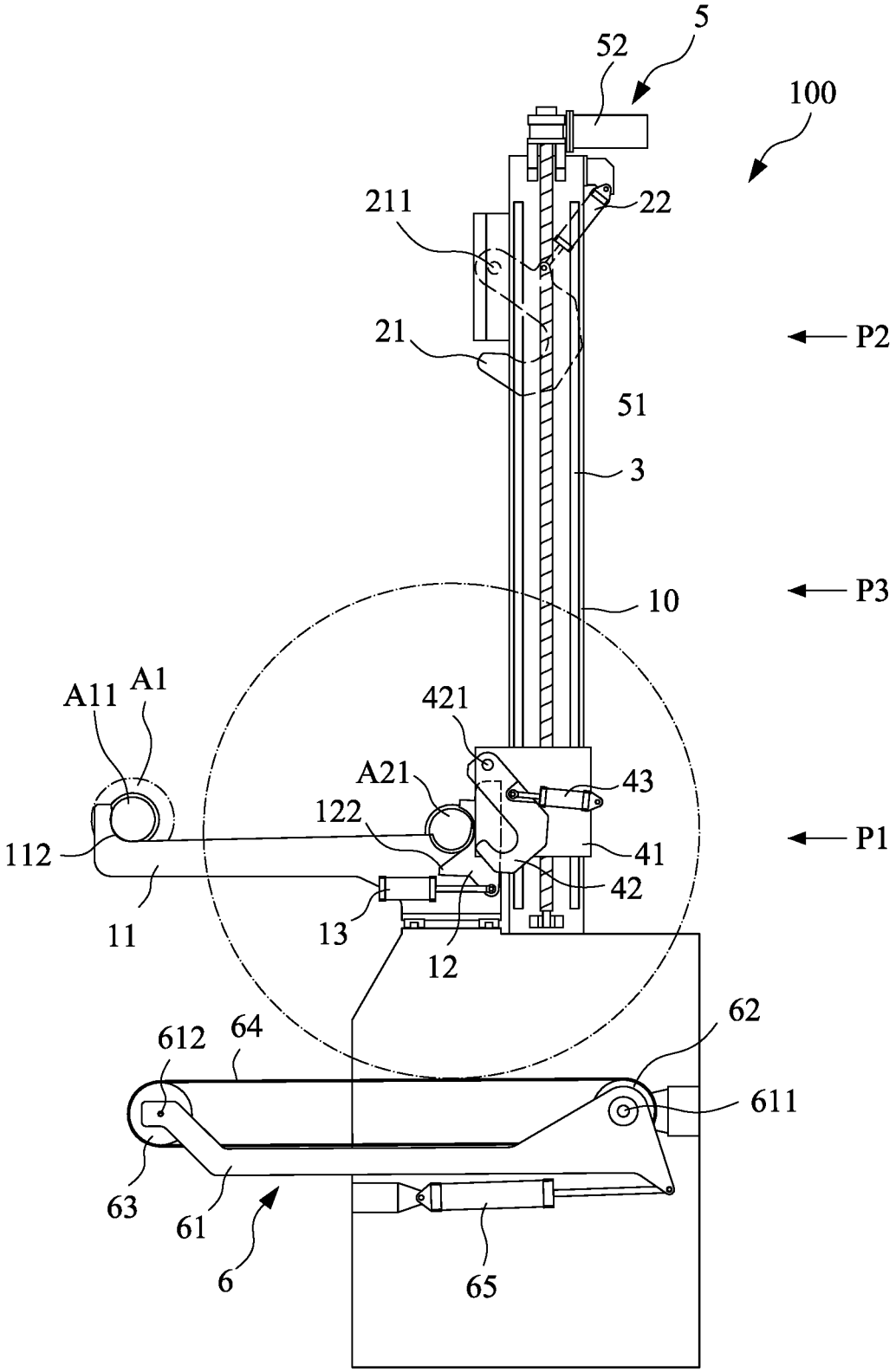
Figure 6J:
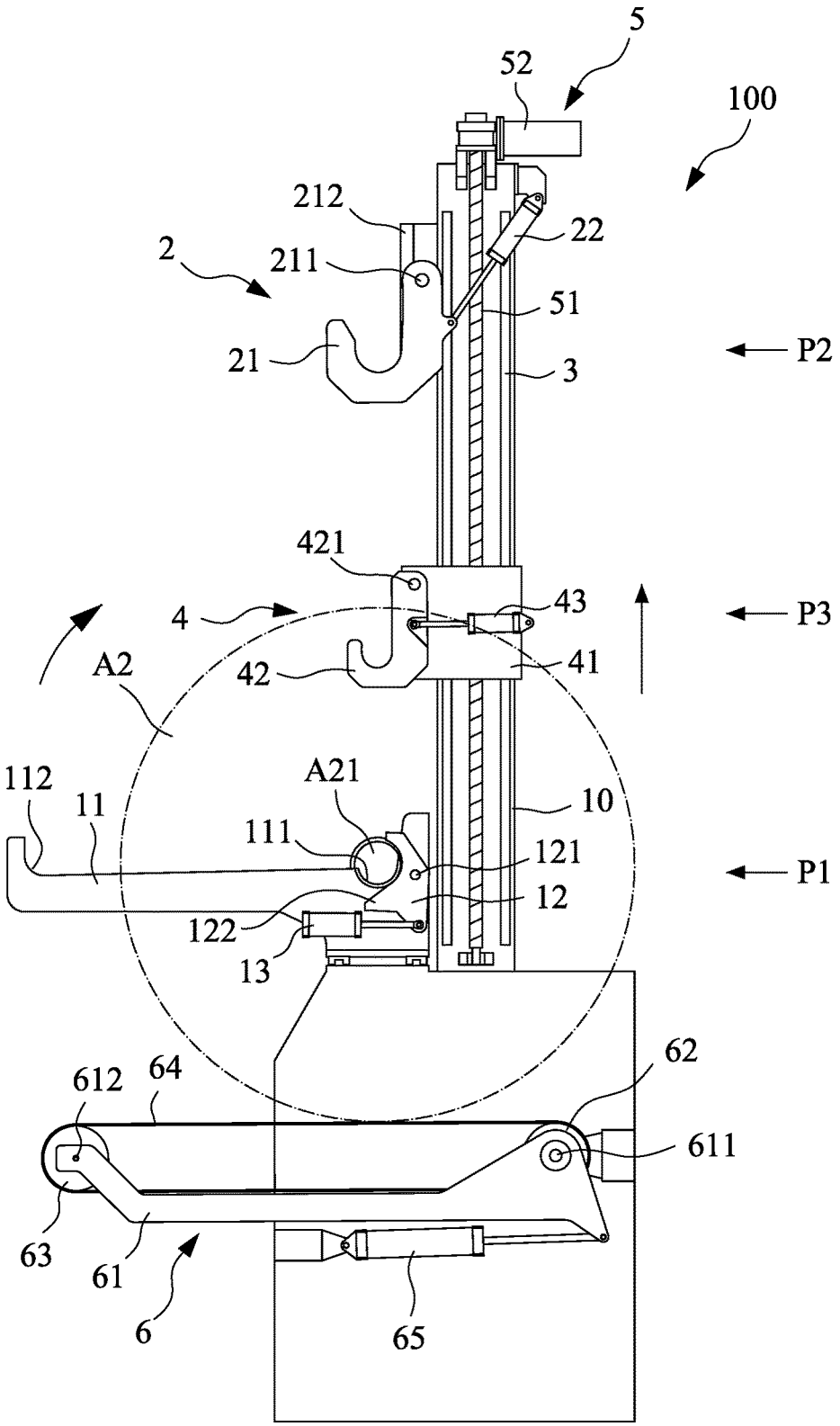

When the second paper roll A2 is deposited in the recess 111 of the inclined arms 11, the elevating hanger 42 of the elevating assembly 4 is driven by the elevating hanger driver 43 to rotate counterclockwise about a rotation center defined by the elevating hanger axle 421 for an angle to a retraction position (as shown in FIG. 6I) to complete the operation of transferring the second paper roll A2 to the paper supply mechanism 1. Afterwards, the elevating assembly 4 elevates back to the standby position P3 (as shown in FIG. 6J) to complete the operation of roll exchange.

After the completion of the roll exchange operation, the second paper roll A2 is driven by the belt 64 of the paper roll rotating mechanism 6 for paper feeding. Finally, the operator may hang and deposit a fresh paper roll on the second paper roll hanger 21 for a next roll exchange operation.

The embodiment discussed above is provided only for illustrating the present invention and is not intended to limit the scope of embodiment of the present invention. Equivalent modifications and substitutions that fall within the spirit of the present invention are considered within the scope of the present invention as defined in the appended claims.

What is claimed is:

1. An apparatus for exchanging paper rolls, comprising:

a paper supply mechanism including a first-roll hanger assembly having an inclined arm and a clamp assembly, the inclined arm having a free end and a positioning end fixed to a machine frame, a recess being formed on the positioning end forms a first roll hanger to receive and support a first paper roll therein;

a second-roll hanger assembly arranged at a position above the first-roll hanger assembly and spaced from the first-roll hanger assembly in a vertical direction, including a second paper roll hanger to receive and support a second paper roll thereon;

a slide rail extending vertically from the first-roll hanger assembly to the second-roll hanger assembly, a feeding position being defined at a bottom end of the slide rail adjacent to the first-roll hanger assembly, a pick-up position being defined at a top end of the slide rail adjacent to the second-roll hanger assembly, and a standby position being defined between the feeding position and the pick-up position;

an elevating assembly movably mounted to the slide rail and including an elevating hanger; and a driving assembly coupled to the elevating assembly and operable to drive the elevating assembly to move upward or downward along the slide rail in the vertical direction to one of the feeding position, the pick-up position and the standby position;

wherein the elevating assembly is driven by the driving assembly to reach the pick-up position to pick up the second paper roll from the second-roll hanger assembly, and then moves along the slide rail to the standby position; and to exchange the first paper roll with the second paper roll, an ejecting part of the clamp assembly of the first-roll hanger assembly ejects and pushes the first paper roll out of the recess, and then the elevating assembly moves downward along the slide rail from the standby position to the feeding position to place the second paper roll into the recess of the inclined arm.

2. The apparatus according to claim 1, wherein the free end of the inclined arm defines a collecting position to receive and hold the first paper roll ejected and pushed out of the recess of the inclined arm by the clamp assembly.

3. The apparatus according to claim 1, wherein the clamp assembly is coupled by a clamp axle to the inclined arm at a location beside the recess, and the clamp assembly is drivable by a clamp driver to rotate about a rotation center defined by the clamp axle.

4. The apparatus according to claim 1, wherein the second paper roll hanger is coupled by a second paper roll hanger axle to the machine frame, and the second paper roll hanger is drivable by a second paper roll hanger driver to rotate about a rotation center defined by the second paper roll hanger axle.

5. The apparatus according to claim 1, wherein the elevating assembly comprises a slide block, the elevating hanger being coupled by an elevating hanger axle to the slide block, the slide block being drivable by the driving assembly to move in the vertical direction along the slide rail to one of the pick-up position, the standby position, and the feeding position.

6. The apparatus according to claim 5, wherein the elevating assembly further comprises an elevating hanger driver coupled to the elevating hanger, and the elevating hanger is drivable by the elevating hanger driver to cause the elevating hanger to rotate by an angle about a rotation center defined by the elevating hanger axle.

7. The apparatus according to claim 5, wherein the driving assembly comprises:

a screw rod, which is in screwing engagement with a screw guide hole formed in the slide block; and a screw rod driving unit coupled to the screw rod to drive the screw rod to rotate in order to cause the slide block to move along the slide rail in the vertical direction.

8. The apparatus according to claim 1, further comprising a paper roll rotating mechanism operable to drive the first paper roll to rotate about a rotation center defined by the recess.

9. The apparatus according to claim 8, wherein the paper roll rotating mechanism comprises:

a lifting rack including an axle and a lifting end;

a belt motor coupled to the axle of the lifting frame;

a guide roller coupled to the lifting end of the lifting frame; and a belt arranged between the guide roller and the belt motor, the belt being set in contact engagement with a paper roll surface of the first paper roll;

wherein the belt is drivable by the belt motor to rotate so as to drive the first paper roll to rotate.

10. The apparatus according to claim 9, wherein the paper roll rotating mechanism further comprises a lifting driver coupled to the lifting rack to drive the lifting rack to rotate about a rotation center defined by the axle, so as to cause the lifting end of the lifting rack to lift upward to set the belt in contact engagement with the paper roll surface of the first paper roll.

* * * * *